US008528739B2

(12) United States Patent
Haile

(10) Patent No.: US 8,528,739 B2
(45) Date of Patent: Sep. 10, 2013

(54) PACKAGE FOR COLORED PRODUCTS

(76) Inventor: Danny Lee Haile, La Mirada, CA (US)

( * ) Notice: Subject to any disclaimer, the term of this patent is extended or adjusted under 35 U.S.C. 154(b) by 90 days.

(21) Appl. No.: 12/951,605

(22) Filed: Nov. 22, 2010

(65) Prior Publication Data

US 2011/0120907 A1 May 26, 2011

Related U.S. Application Data

(60) Provisional application No. 61/264,490, filed on Nov. 25, 2009.

(51) Int. Cl.
*B65D 25/54* (2006.01)

(52) U.S. Cl.
USPC ..... 206/776; 220/662; 427/282

(58) Field of Classification Search
USPC ..... 206/457, 776, 777, 581; 220/663, 220/662; 215/12.2; 40/310; 427/282, 189; 53/131.1
See application file for complete search history.

(56) References Cited

U.S. PATENT DOCUMENTS

| | | | | |
|---|---|---|---|---|
| 2,294,574 | A * | 9/1942 | Ravenscroft et al. | 215/12.1 |
| 3,547,294 | A * | 12/1970 | Williams | 215/12.2 |
| 3,896,014 | A | 7/1975 | Rosenberg | |
| 4,569,869 | A * | 2/1986 | Kushida et al. | 428/35.7 |
| 6,082,777 | A * | 7/2000 | Grosskopf et al. | 283/81 |
| D429,154 | S | 8/2000 | Chang | |
| 7,010,877 | B2 * | 3/2006 | Geary | 40/310 |
| 7,703,226 | B2 * | 4/2010 | Schnuckle | 40/310 |
| D651,515 | S | 1/2012 | Haile | |
| D651,521 | S | 1/2012 | Haile | |
| D656,824 | S | 4/2012 | Haile | |
| 2003/0196914 | A1 | 10/2003 | Tzou et al. | |
| 2007/0095721 | A1 * | 5/2007 | Davis et al. | 206/581 |
| 2007/0282293 | A1 * | 12/2007 | Janus | 604/404 |
| 2010/0326867 | A1 * | 12/2010 | Fresnel | 206/459.5 |
| 2011/0180510 | A1 * | 7/2011 | Julien et al. | 215/379 |

FOREIGN PATENT DOCUMENTS

| | | |
|---|---|---|
| DE | 19629392 | 8/1997 |
| JP | 1202886 | 4/2004 |
| KR | 30-0266534 | 9/2000 |
| WO | 2007/052226 | 5/2007 |
| WO | 2011/066262 | 6/2011 |

OTHER PUBLICATIONS

Pdf file of Nalgene Labware Model 2019 Square Media Bottle, from www.nalgenelabware.com website. Prior 2005.*
International Search Report mailed Mar. 15, 2011 for PCT/US2010/057756 filed Nov. 23, 2010.
Written Opinion of the International Searching Authority mailed Mar. 15, 2011 for PCT/US2010/057756 filed Nov. 23, 2010.
International Preliminary Report on Patentability issued May 30, 2012 for PCT/US2010/057756 filed Nov. 23, 2010.

* cited by examiner

*Primary Examiner* — David Fidei
(74) *Attorney, Agent, or Firm* — Walter C. Frank; Feldman Gale, P.A.

(57) ABSTRACT

Disclosed are packages including transparent containers such as bottles and jars comprising a coating that reduces transmission of light through the container. The containers further comprise a product viewing area or window through which the product is visible to a consumer or purchaser. The containers are disclosed as being useful for protecting photosensitive products while allowing the color of those products to be displayed to the user.

20 Claims, 4 Drawing Sheets

PACKAGE FOR COLORED PRODUCTS

CROSS REFERENCE TO RELATED APPLICATION

This application claims priority to U.S. Provisional Application Ser. No. 61/264,490, filed Nov. 25, 2009, and to Japanese National Application 2010-012837, filed May 25, 2010, the entire disclosures of which are hereby incorporated herein by reference in their entireties.

FIELD OF THE INVENTION

This relates to packages for cosmetic products, and in particular packages for light-sensitive, or photo-curable colored cosmetic products.

BACKGROUND OF THE INVENTION

Certain products intended for the consumer market have a color attribute that is important as a selection factor for consumer purchase. For example, cosmetic products, such as skin care products, eye care products, lip care products, and nail products are frequently selected for purchase by consumers based at least in part on their color. For certain other products, such as many paints, stains, and/or colorants of various types, color is among the primary considerations of a purchaser or user. Thus, it may be important for a consumer to see the actual color of the product in its container, rather than merely to see a "representative sample" of that color, for example, on a label.

However, some colored products are sensitive to one or more wavelengths of light, for example, ultraviolet ("UV") light. The products may bleach, polymerize, oxidize, or otherwise be deleteriously affected by significant exposure to such wavelengths. Still other products are specifically designed to be "activated" or "cured" by a particular type or wavelength of light, e.g. one or more wavelengths of UV light. For example, certain products are designed to gel or polymerize upon exposure to UV light, or certain LEDs.

The invention disclosed herein provides improved packaging for protecting light-sensitive or light-curable products, particularly cosmetic products, from potentially damaging effects of environmental light exposure that, e.g. may occur during storage or while being merchandised, while allowing the color or colors of the product to be readily visible to consumers prior to purchase.

SUMMARY OF THE INVENTION

The inventor has surprisingly discovered that a light-sensitive or light-activated product can be stored and merchandised in a transparent container coated with a coating that restricts the transmission of light that would otherwise pass therethrough, and by the inclusion of a small transparent product viewing area, the product's color can be observed. This is particularly useful for products whose color is an important determinant or criterion for consumer selection and purchase. The coating is preferably opaque, or substantially opaque. The viewing area, or window, is preferably less than about 25% of the surface area of the container, which is preferably a bottle.

In a first aspect of the invention, provided is a packaging system for use with a consumer product, particularly a colored consumer product, wherein the color attribute is important to a prospective purchaser of the consumer product. The packaging system generally comprises a substantially transparent container having a coating thereon. The coating is adapted to substantially reduce transmission of light of at least one wavelength that can pass through the otherwise transparent container, e.g., to the contents thereof. The coated container has at least one substantially transparent product viewing area that allows a consumer to observe the color of the product. Preferably, the container is a glass bottle, the coating is a baked-on powder coating, and the product is a cosmetic product, such as a product for nails, e.g. polish, gel, or the like. Also, preferably the product is light-curable and/or sensitive to light, such as UV light, particularly UV light of one or more wavelengths that can pass through the transparent container in the absence of the coating.

In a second of its several aspects, provided are cosmetic containers comprising a transparent bottle or jar substantially covered with a coating. The containers comprise at least one transparent product viewing area adapted to allow the product to show therethrough or be readily observed by a consumer or prospective purchaser. The coating substantially reduces transmission of at least one wavelength of light that would otherwise pass through the bottle or jar to the contents. In one embodiment, the bottle or jar is used for cosmetic products, such as nail products, including nail polish, nail gels, or combinations thereof, whose color is an important attribute for a consumer or purchaser.

In yet another of its several aspects, the invention provides methods of reducing undesired curing of a photo-curable product comprising the steps of:

- providing a transparent bottle in which to store the product;
- masking at least one surface area of the bottle with a masking material;
- coating the masked bottle with a coating material that blocks at least one wavelength of light that would otherwise pass through the bottle, and that can cause the photo-curable product to cure;
- removing the mask to produce a product viewing area;
- filling the bottle with the photo-curable product; and
- storing the product such that a thin film of cured product forms behind the product viewing area and that no substantial further curing occurs in the product.

Preferably, the photo-curable product is colored and the color of the product is thus fully observable to a consumer or prospective purchaser, i.e., through the product viewing area.

In yet another of its aspects, provided herein are "kits" for reducing undesired curing of a photo-curable product, the kits generally comprise:

a) a transparent bottle substantially covered with a coating and having at least one transparent product viewing area adapted to allow a photo-curable product contained in the bottle to show therethrough; wherein the coating substantially reduces transmission of at least one wavelength of UV light that would otherwise pass through the bottle to the photo-curable product contained therein;

b) a removable cap, lid, or applicator for adapted for removably sealing the bottle; and optionally, c) a UV-curable product for storing therein.

These and other aspects of this disclosure will be more fully described, along with further details of how to make and use them, with reference to the drawings and detailed description that follows.

DETAILED DESCRIPTION OF THE PREFERRED EMBODIMENTS

Figure 1:
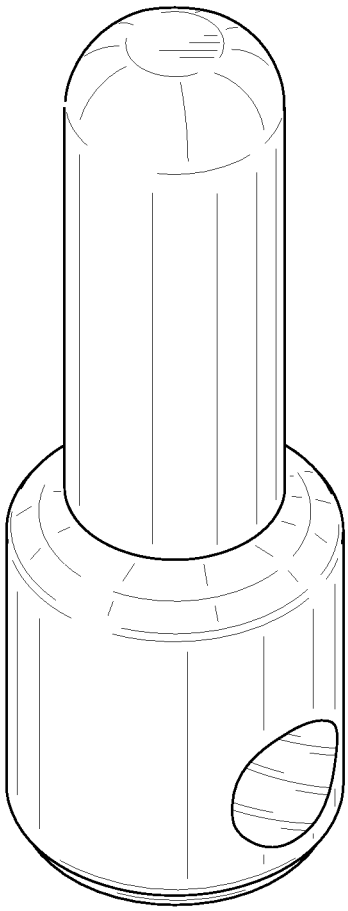
FIG. 1 depicts a perspective view of a nail polish-type bottle as an embodiment of the packaging system of the present invention. The container shown is a transparent cylindrical bottle covered with a coating, and featuring a substantially circularly configured transparent product viewing area. The coating is a powder coating that is substantially opaque. Also depicted is an optional cap.

Disclosed herein are packages for protecting a colored, light-sensitive product from damaging light exposure, while simultaneously allowing the product to be seen by a potential purchaser by the use of one or more discreet viewing windows that allow the colored product to show through. The packages are generally packages such as bottles or jars that normally are clear, i.e., transparent to most forms of light, including various wavelengths of UV light. The packages disclosed herein are modified in one of several ways so as to be substantially less transparent or even opaque. However, to allow the product to be observed by the purchaser, the package features a viewing window that is substantially transparent to allow the consumer or purchaser to observe the color of the product.

Surprisingly, the inventor has discovered that the inclusion of a product viewing area or window in a coated package that substantially precludes light that would otherwise pass through the package does not result in significant curing, hardening, spoilage, or the like, of the product. This is particularly useful for products that cure, harden, polymerize, set, or gel, or whose desirable properties are otherwise altered by exposure to the light that would pass through the package in the absence of the coating. Rather, while the color can be observed through the product viewing area, the exposure of the product to the reduced amount of light passing through the product viewing area of the coated transparent container, e.g., bottle, or jar, does not result in complete curing of the product. Instead, only a small amount is affected, such as a thin-film of cured or hardened product that forms in the vicinity of the product viewing area or window. Without being bound to any one theory of operation, it is presently believed that by not exceeding a certain amount of light exposure, certain products, such as photo-curable cosmetic products, will not be substantially impacted adversely by the exposure to the light passing through the product viewing area. Moreover, it appears that the thin film that forms serves to help protect the remaining bulk product from further or more extensive potentially undesirable light exposure.

Thus, in one aspect of the invention, provided are packaging systems for use with consumer products having color as a significant attribute, for example as a purchasing criterion. The system comprises a substantially transparent container having a coating that substantially reduces transmission of light that would pass through said container in the absence of the coating. The coating need not reduce the transmission of all light, nor even light of all wavelengths, rather the coating need only reduce the transmission of at least one wavelength of light. The coated container has at least one substantially transparent product viewing area. The viewing area is adapted to allow a consumer to observe the color of the product in the container.

In preferred embodiments of the packaging system, the container is a bottle or jar. While any type of container can be used, presently preferred containers for use herein are primarily glass containers, such as bottles, jars, and the like. For example, when the product is a nail polish or gel-type product, any of the wide range of commercially available nail polish bottle shapes may be employed and coated as describe herein.

The coating can comprise any type of coating that is compatible with the container, and can be applied by any means known in the art. In one embodiment, the coating is a powder coating, a metalized coating, a painted coating, or an overwrap. Where the coating is a powder coating, a painted coating, or a metalized coating, or the like, the product viewing area can be conveniently formed by applying a removable masking material on the container prior to the coating, and subsequently removing said masking material after the coating process. The coating process in various embodiments may involve one or more steps of heating the container and thus is preferably conducted before the container is filled with product, however, other embodiments may be practiced before, during, or after a filling operation.

In one embodiment, the product is photo-curable or photosensitive, and the coating substantially reduces the transmission of at least one wavelength of visible or UV light (in one or more of the UV-A, UV-B, or UV-C ranges). In the absence of the coating, the light would otherwise pass through the container to the product, and cause a detrimental effect on the product during storage, display/merchandising, or subsequent use.

By "substantially reducing" it is generally intended that at least a 20% reduction of light transmission of at least one wavelength of light occurs; more preferably at least 30, 40, or 50% or more of one or more wavelengths of light. In one presently preferred embodiment, the coating is a generally opaque coating, reducing transmission of visible light that would otherwise pass through to the package contents by at least 80%, 90%, or even more.

In various embodiments, the packaging system further comprises a cap, a lid, a top, or an applicator. Such caps, including applicator caps are known in the art and commonly used with color products, including cosmetics, paint (e.g. touch-up paint), etc.

In a presently preferred embodiment, the consumer product is a cosmetic product. Examples of products for which the packages described herein are particularly useful include nail products, including nail polish, nail gel, or combinations and/or modifications thereof.

In a second aspect, the invention provides cosmetic containers comprising a transparent bottle or jar. The container, e.g. bottle, is substantially covered with a coating that substantially reduces the amount of at least one wavelength of light that would otherwise pass through the bottle to the contents. The container features at least one transparent product viewing area that is adapted to allow the product to show through the viewing area/window.

In various embodiments, the coating for the container is a powder coating, a painted coating, a metalized coating, or an overwrap. For applications where the coating is a powder coating, a painted coating, or a metalized coating, the viewing area or window can be formed by applying masking material prior to and during the coating process, and subsequently removing the masking material to uncover a transparent viewing area in the shape of the mask. Techniques for masking and unmasking in connection with the application of paints, coatings and the like are known in the art. The masks can comprise one or multiple portions such that when removed the viewing area may comprise a single area in the shape of the mask, or may comprise multiple areas.

Where a single viewing area is used it is desirable to have the area appear attractive to the consumer. Any shape can be used including geometric shapes (circles, ellipses, ovals, triangles, squares, rectangles, and other polygons of any number of sides or shape). In addition the viewing area can be a free-form shape, or could comprise logo, design, or the like. Viewing areas in the shape of objects of nature (e.g. flowers, petals, bouquets, plants, trees, feathers, etc.), symbols (e.g. hearts), people or body parts (e.g. eyes, hands, face), or other real world object may also be useful for the overall shape of a viewing area such that the product and its color can be observed. Where the viewing area comprises multiple areas, the shape of such areas is limited only by the human imagination and includes such designs as floral designs, free-flowing forms and curves, balloons, fireworks combinations of any of the aforementioned, for example multiple smaller circles, flowers, etc. are also contemplated for use herein.

In various embodiments, the product viewing area comprises less than about 25% of the surface area of the bottle. Preferably the product viewing area is less than about 20% of the bottle. In some embodiments, less than 15, 12, or even 10% of the surface remains as a transparent viewing area. The inventor has found that generally for light-sensitive products, and particularly for those that are designed to be photo-cured, a viewing area in excess of about 25% of the surface area normally exposed to light will not provide the thin film behind the viewing window, but rather will result in light-induced changes to the bulk of the product, and thus the product will be rendered substantially useless for its intended purpose.

In preferred embodiments herein, the product is nail polish or nail gel, or a combination or modification thereof. Jars or bottles for use with colored cosmetics are known in the art, and presently preferred bottles for nail products include cylindrical bottles (for example, in 15 ml, or 0.5 oz size). Other shapes are also useful and many are commercially available under a variety of trade names.

Figure 3:
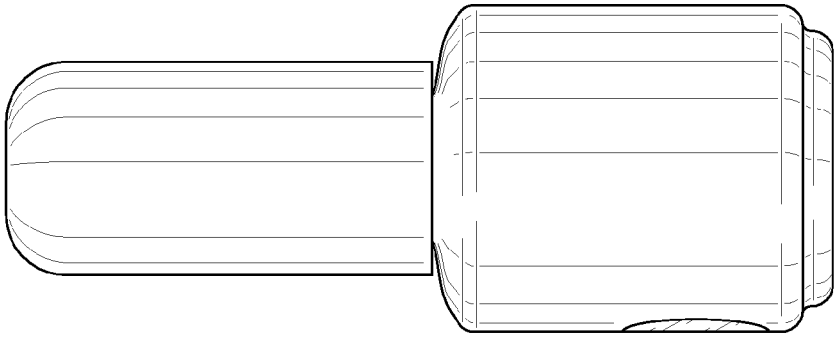
FIG. 3 depicts a side view of a nail polish-type bottle as an embodiment of the packaging system of the present invention.
Figure 2:
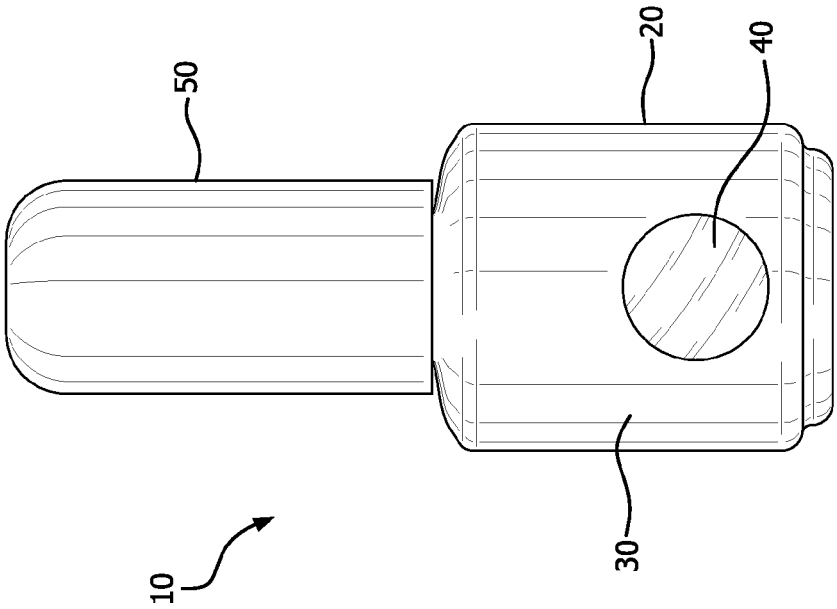
FIG. 2 depicts a front view of a nail polish-type bottle as an embodiment of the packaging system of the present invention.

Further description of the packages will be facilitated by reference to the Figures. FIGS. 1, 2, and 3 depict several views of an embodiment of the present invention. FIG. 2 depicts a front view of an embodiment of the packaging system 10. The container 20 shown is a transparent cylindrical bottle 20 covered with a coating 30, and featuring a transparent product viewing area 40. The coating 30 is a powder coating that is substantially opaque. Also depicted is an optional cap 50. The cap 50 can be of any type or style that is compatible with the product for which the packaging system 10 is intended. In cosmetic applications, applicator caps are known and typically used for nail products such as polishes and gels.

It should be noted that the relative dimensions of the various components of the packaging system, containers, bottles, jars, etc disclosed herein can vary according to need.

And as discussed above, the overall shape of the container can also vary according to design preferences. For example, various types of bottles have become recognized as industry "standards" and may be conveniently used in connection with this disclosure. Alternatively, any shaped container, including unique or custom shapes can be adapted with a coating and product viewing area as disclosed.

Figure 4:
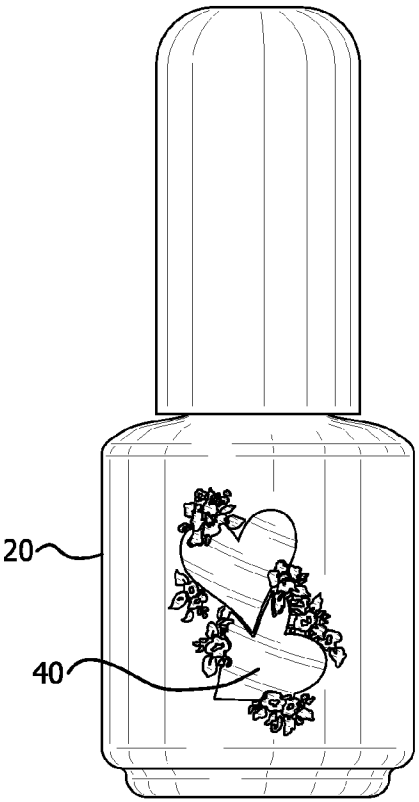

With further reference to the figures, FIG. 4 depicts another embodiment of the packaging system 10 showing a container 20 of similar overall shape, and featuring a product viewing area 40 of different shape/style.

Figure 6:
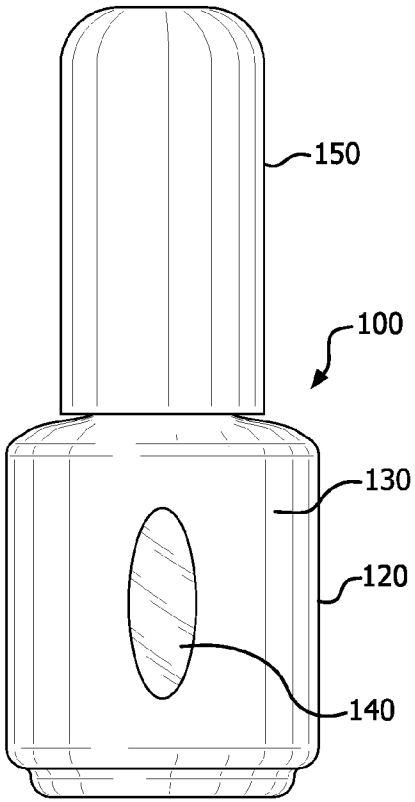
FIGS. 4, 5, and 6 each depict a front view of a nail polish bottle having a different product viewing window as an alternative embodiment of the packaging system of the present invention. Each figure depicts an alternative configuration for the transparent window for viewing the bottle's contained product, such as two hearts (FIG. 4), a square (FIG. 5), or oval (FIG. 6). To produce a product viewing area such as for FIG. 4 (two hearts), multiple areas may be separately masked-off prior to/during the coating process.
Figure 5:
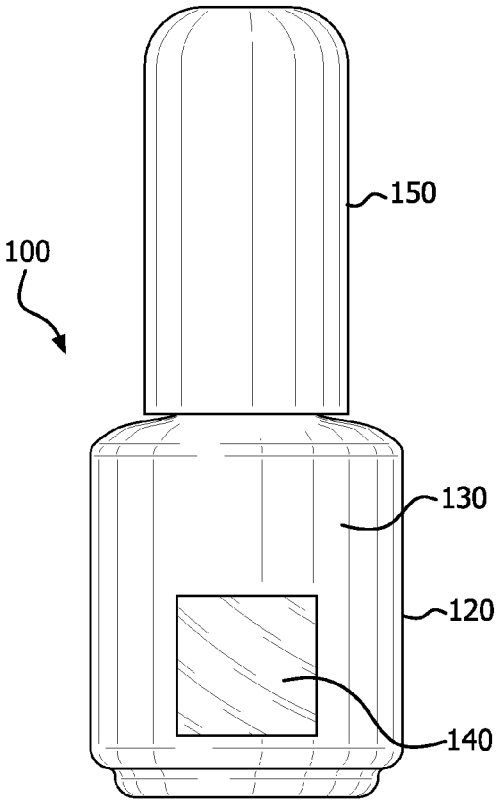

With yet further reference to the figures, FIGS. 5 & 6 each depict an embodiment of a cosmetic container 100 useful for nail polish, gel, or the like. As with the packaging system above, the bottle 120 is covered with a coating 130. The bottles 120 each have a transparent product viewing area 140. Optional caps 150 are also shown and may be applicator caps. The embodiments of the cosmetic container 100 in FIGS. 5 and 6 show different product viewing area configurations with FIGS. 5 and 6 showing a single viewing area, and FIG. 4 showing a viewing area with multiple discreet sections that are not connected. To produce this product viewing area, multiple areas can be separately masked-off prior to/or during the coating process.

Figure 9:
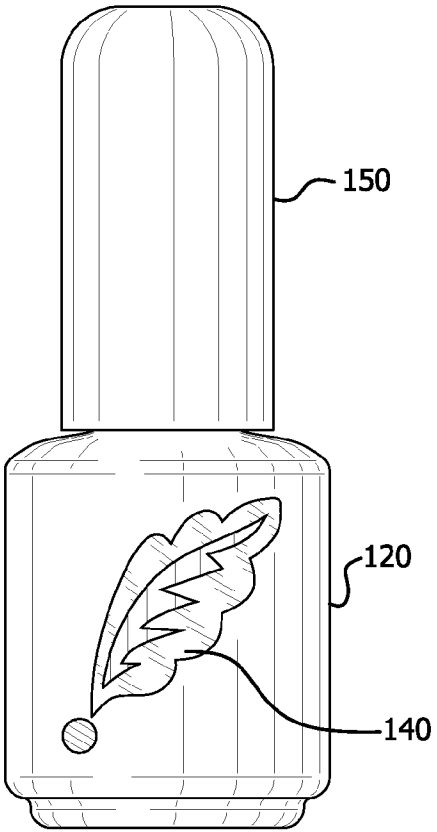
FIGS. 7, 8, and 9 each depict a front view of a nail polish bottle having a different product viewing window as an alternative embodiment of the packaging system of the present invention. Each figure depicts an alternative configuration for the transparent window for viewing the bottle's contained product, such as diamond (FIG. 7), clover leaf (FIG. 8) and feather (FIG. 9). To produce a product viewing area for FIGS. 7, 8, and/or 9, multiple areas may be separately masked-off prior to/during the coating process.
Figure 8:
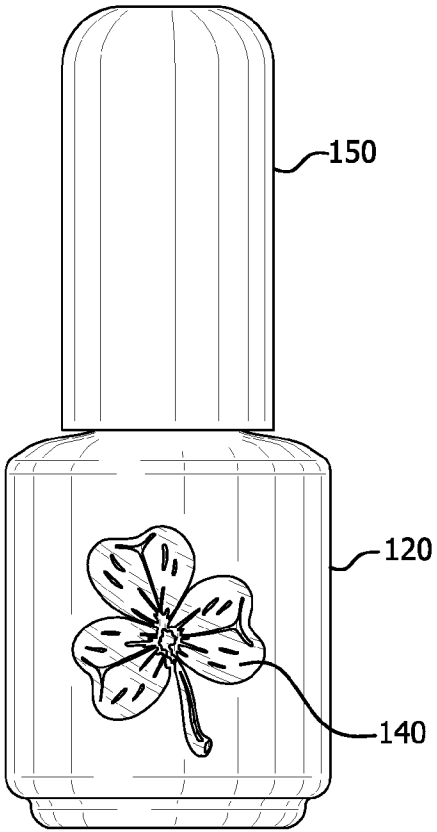
Figure 7:
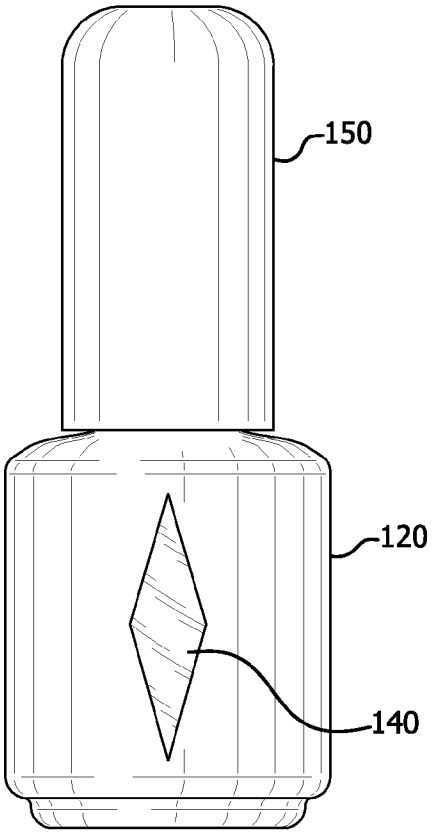

With yet further reference to the figures, FIGS. 7, 8, and 9 show several different configurations of the cosmetic container 100 embodied as nail polish bottles of different types commonly known in the art. Each container 120 depicts one or more product viewing areas 140 of different design to allow the product (not shown) to be observed therethrough while enhancing the appeal of the container or bottle 120. Optional caps 150 are shown for each bottle 120.

In another aspect of the invention, methods of reducing undesired curing of a photo-curable product while allowing the product to be seen in its container, the method comprising the steps of:

providing a transparent container in which to store the product;

masking at least one surface area of the container with a masking material;

coating the masked container with a coating material that blocks at least one wavelength of light that would otherwise pass through the container, and which can cause the photo-curable product to cure;

removing the mask to produce a product viewing area; and filling the coated container with the photo-curable product whereby the product can be seen through the product viewing area.

Preferably the container is a bottle, such as a glass bottle. In one embodiment, the photo-curable product is colored and the color is observable to a consumer through the product viewing area, when the product is in the container. In another embodiment, the photo-curable product is a cosmetic product for use on, e.g. nails.

In one embodiment, the photo-curable product can be cured by exposure to UV light or an LED light source of a particular wavelength that is effective to cure the photo-curable product, and the coating blocks out at least that wavelength of light. In other embodiments, a thin film of the cured product forms on the inside of the container in the vicinity of the product viewing area, and further curing is substantially curtailed, thereby extending the life and utility of the product.

In yet another aspect of the present invention, a kit for reducing undesired curing of a UV-curable product comprising together, in one or more packages:

a transparent container substantially covered with a coating and having at least one transparent product viewing area adapted to allow a UV-curable product contained in the bottle to show therethrough; wherein the coating substantially reduces the amount of at least one wavelength of UV light that would otherwise pass through the container to the UV-curable product contained therein;

a removable cap, lid, or applicator for adapted for removably sealing the container; and optionally, a UV-curable product for storing in the container.

The product viewing area generally comprises less than about 20% of the surface area of the container, which is preferably a bottle.

In one presently preferred embodiment, the product is a cosmetic product for use with nails. The color of the product can be readily observed through the product viewing area.

The kits can optionally include instructions for use of the product or instructions for avoiding undesired or premature curing of the product.

The foregoing has described several embodiments of the packages including the packaging systems, cosmetic containers, bottles, jars, and the like provided herein, as well as methods of making and using those packages, and kits comprising them. These and other aspects of the invention will become clearer through the examples provided below.

Example

There are recognized difficulties in storing and displaying UV-sensitive product in a manner that both protects them from substantial UV exposure and/or the effects thereof, and so that a consumer can see the attributes of the product, for example, an appealing color. Further, it was believed that the UV-curable products could not be stored and/or displayed in a package that allowed any UV light to pass through to the contents. In accordance with the disclosure, surprisingly, the inventor has discovered that if a transparent container, such as a glass bottle, is coated with a coating that restricts light transmission therethrough, a small transparent viewing window can be left through which the product color can be observed. The window is preferably less than about 25% of the surface area of the bottle.

Glass bottles are provided and, in preparation for a powder coating step, each is cleaned and inspected for blemishes. A small area comprising less than about 20% of the surface area of each bottle is masked off using materials that do not accept the powder coating and which are easily removed after coating. Powder for the coating is applied and cured according to the manufacturer's recommendations. The masking material is removed to reveal a product viewing "window". The bottles are examined for coverage and quality then packed for customer delivery. The bottles are later filled, and adapted with a cap, such as an applicator cap. The product in the bottle is generally colored and photo-sensitive and preferably photo-curable, and the color of the product can be readily seen through the substantially transparent product viewing area.

Upon later analysis, it will be found that a bulk of the product remains in good useful condition despite the ongoing exposure to light through the product viewing area. In some cases, it is found that a thin film of cured product on the inside of the bottle has formed on/in the vicinity of the product viewing window.

There have been described and exemplified herein a number of embodiments of packages including the packaging systems, cosmetic containers, bottles, jars, and the like, along with methods for making and using those packages, as well as kits and systems comprising the packages. The specific embodiments provided were primarily selected to illustrate the features of the packages to the understanding of the skilled artisan. Such a skilled artisan will appreciate that various modifications and alterations can be made to the specific embodiments exemplified, and that such modification and alterations are within the intended scope of the invention as defined in the appended claims.

What is claimed is:

1. A packaging system for use with a photo-curable consumer product having a color attribute, the system comprising a substantially transparent container having a coating thereon adapted to substantially reduce the transmission of light of at least one wavelength capable of photo-curing said consumer product that would pass through said container in the absence of the coating, said coated container having at least one substantially-transparent product viewing area thereon wherein said viewing area is adapted to allow a consumer to observe the color attribute of the product therethrough; and wherein said viewing area substantially lacks said coating;

wherein said consumer product is a nail polish, nail gel, or a combination or modification thereof.

2. The packaging system of claim 1 wherein the container is a bottle or jar.

3. The packaging system of claim 1 wherein the coating is a powder coating, a metalized coating, a painted coating, or an overwrap.

4. The packaging system of claim 3, wherein said product viewing area is made by a process comprising the steps of:

providing a transparent container in which to store said product;

applying removable masking material onto the container prior to its coating;

coating said container with a powder coating, a painted coating, or a metalized coating;

and subsequently removing said masking material from said coated container to provide the product viewing area;

wherein said viewing area allows a consumer to observe the color attribute of the product therethrough.

5. The packaging system of claim 1 wherein the coating substantially reduces the transmission of at least wavelength of UV light in the UV-A, UV-B, or UV-C range.

6. The packaging system of claim 1 wherein the coating is opaque.

7. The packaging system of claim 1 further comprising a cap, a lid, a top, or an applicator.

8. A cosmetic container for containing a colored photo-curable cosmetic product, said container comprising a transparent bottle substantially covered with a coating and having at least one transparent product viewing area adapted to allow the product to show therethrough; wherein the coating substantially reduces transmission of at least one wavelength of light capable of photo-curing said colored cosmetic product that would otherwise pass through the bottle to the contained colored cosmetic product;

wherein said viewing area substantially lacks said coating; and wherein said colored cosmetic product is a nail polish, nail gel, or a combination or modification thereof.

9. The cosmetic container of claim 8 wherein the coating is a powder coating, a painted coating, a metalized coating, or an overwrap.

10. The cosmetic container of claim 9, wherein said product viewing area is made by a process comprising the steps of:

providing a transparent container in which to store said product;

applying removable masking material onto the container prior to its coating;

coating said container with a powder coating, a painted coating, or a metalized coating;

and subsequently removing said masking material from said coated container to provide the product viewing area;

wherein said viewing area allows a consumer to observe the color attribute of the product therethrough.

11. The cosmetic container of claim 8 wherein the product viewing area comprises less than 20% of the surface area of the bottle.

12. A method of reducing undesired curing of a photo-curable product comprising the steps of:

providing a transparent bottle in which to store the product;

masking at least one surface area of the bottle with a masking material;

coating the masked bottle with a coating material that blocks transmission of at least one wavelength of light capable of photo-curing the product that would otherwise pass through the bottle;

removing the mask to produce a product viewing area; and filling the bottle with the photo-curable product, and capping said bottle;

wherein said photo-curable product is a nail polish, nail gel, or a combination or modification thereof.

13. The method of claim 12 wherein the photo-curable product is colored and wherein the product's color is observable to a consumer through the product viewing area.

14. The method of claim 12 wherein the photo-curable product can be cured by exposure to UV light or an LED light source emitting at least one wavelength of light effective to photo-cure the product.

15. A kit for reducing undesired curing of a photo-curable product comprising:

a transparent bottle substantially covered with a coating and having at least one transparent product viewing area adapted to allow a photo-curable product contained in the bottle to show therethrough; wherein the coating substantially reduces transmission of at least one wavelength of light capable of photo-curing the product that would otherwise pass through the bottle to the photo-curable product contained therein;

a removable cap, lid, or applicator adapted for removably sealing the bottle;

wherein said photo-curable product is a nail polish, nail gel, or a combination or modification thereof.

16. The kit of claim 15 wherein the product viewing area comprises less than about 20% of the surface area of the bottle.

17. The kit of claim 15 said coated bottle contains a colored photo-curable cosmetic product for use with nails, and wherein the color of the product can be observed through the product viewing area.

18. The kit of claim 15 further comprising instructions for use of the product.

19. A packaging system for use with a consumer product having a color attribute, the system comprising a substantially transparent container having a coating thereon adapted to substantially reduce the transmission of light of at least one wavelength that would pass through said container in the absence of the coating, said coated container having at least one substantially-transparent product viewing area thereon wherein said viewing area is adapted to allow a consumer to observe the color attribute of the product therethrough;

wherein said consumer product is a nail polish, nail gel, or a combination or modification thereof.

20. A process for preparing a packaging system for use with a photo-curable consumer product having a color attribute, said process comprising:

providing a container which is transparent to light of at least one wavelength capable of photo-curing said consumer product;

applying removable masking material onto a portion of the container surface prior to its coating;

coating said container with a powder coating, a painted coating, or a metalized coating; and subsequently removing said masking material from said coated container surface; to provide said packaging system with a transparent viewing area for use with a consumer product having a color attribute;

wherein said coating substantially reduces the transmission of light of at least one wavelength capable of photo-curing said consumer product;

wherein said product viewing area is transparent to said wavelength of light and allows a consumer to observe said color attribute of the product therethrough; and wherein said consumer product is a nail polish, nail gel, or a combination or modification thereof.

* * * * *